US008240345B2

(12) United States Patent
Ender et al.

(10) Patent No.: US 8,240,345 B2
(45) Date of Patent: Aug. 14, 2012

(54) FLUID SUPPLY CAP

(75) Inventors: Ronald J. Ender, Corvallis, OR (US); Craig L. Malik, Corvallis, OR (US); Norman E. Pawlowski, Corvallis, OR (US); Benjamin Zoladz, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/087,375

(22) Filed: Apr. 15, 2011

(65) Prior Publication Data

US 2011/0197991 A1 Aug. 18, 2011

Related U.S. Application Data

(63) Continuation of application No. PCT/US2008/079953, filed on Oct. 15, 2008.

(51) Int. Cl.
*B65B 3/04* (2006.01)

(52) U.S. Cl. ..... 141/20; 141/25; 141/351; 141/114; 141/291; 222/94; 222/386.5; 222/400.7; 347/85

(58) Field of Classification Search ..... 141/3, 20, 141/23, 25, 348, 349, 351, 68, 114, 291; 222/95, 105, 402.1, 386.5, 94, 400.7, 400.8; 347/85
See application file for complete search history.

(56) References Cited

U.S. PATENT DOCUMENTS

| | | | | |
|---|---|---|---|---|
| 3,862,705 | A | 1/1975 | Beres et al. | |
| 5,115,944 | A | 5/1992 | Nikolich | |
| 6,318,850 | B1 * | 11/2001 | Childers et al. | 347/85 |
| 6,322,205 | B1 * | 11/2001 | Childers et al. | 347/85 |
| 6,619,789 | B2 * | 9/2003 | Childers et al. | 347/85 |
| 7,059,582 | B2 | 6/2006 | Adams et al. | |
| 7,124,788 | B2 * | 10/2006 | Pericard | 141/20 |
| 7,188,918 | B2 * | 3/2007 | Childers et al. | 347/7 |
| 7,828,173 | B2 * | 11/2010 | Geier et al. | 222/105 |

* cited by examiner

*Primary Examiner* — Timothy L Maust
*Assistant Examiner* — Timothy Kelly

(57) ABSTRACT

A fluid supply includes a container, a bag within the container and a cap. The cap provides a fluid interface in communication with an interior of the bag and a pressurization interface in communication with an interior of the container adjacent an exterior of the bag. The pressurization interface has a channel that concentrically extends about the fluid interface.

19 Claims, 6 Drawing Sheets

FLUID SUPPLY CAP

CROSS-REFERENCE TO RELATED PATENT APPLICATIONS

The present application is a continuation of co-pending PCT/US2008/079953 filed on Oct. 15, 2008 by Ronald J. Ender, Craig L. Malik, Norman E. Pawlowski and Benjamin Zoladz and entitled FLUID SUPPLY CAP, the full disclosure of which is hereby incorporated by reference. The present application is related to U.S. Provisional Patent Application Ser. No. 61/083,906 filed on Jul. 26, 2008 by Ronald J. Ender, Craig L. Malik, Norman E. Pawlowski and Benjamin Zoladz and entitled FLUID SUPPLY, the full disclosure of which is hereby incorporated by reference.

BACKGROUND

Fluid supplies supply fluid to fluid consuming devices. Connecting and disconnecting such fluid supplies to the fluid consuming devices and expelling fluid from the fluid supply may involve complex, space consuming and expensive components.

DETAILED DESCRIPTION OF THE EXAMPLE EMBODIMENTS

Figure 1:
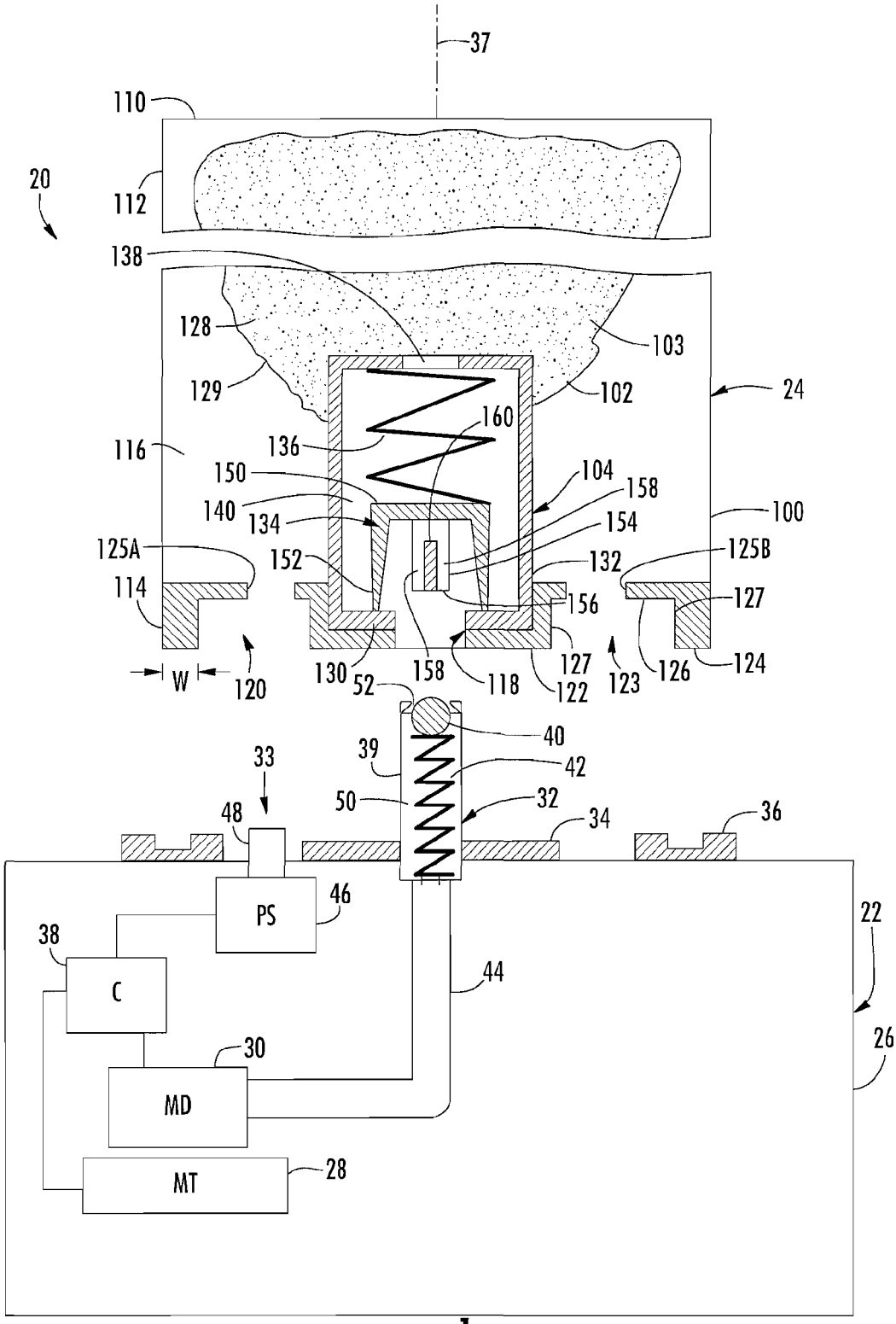
FIG. 1 is a schematic illustration of a fluid supply and receiving system in a disconnected state according to an example embodiment.

FIG. 1 schematically illustrates fluid supply and receiving system 20 according to an example embodiment. System 20 includes a fluid receiver 22 and a fluid supply 24. As will be described hereafter, fluid supply 24 has a one-piece cap providing a compact and less complex arrangement of features forming fluid interfaces for connecting fluid supply 24 to fluid receiver 22 so as to inject air or gas into the fluid supply 24 to expel fluid from fluid supply 24.

FIG. 1 illustrates fluid receiver 22 and fluid supply 24 in disconnected states. Fluid receiver 22 comprises a device configured to receive and consume fluid. In the example illustrated, fluid receiver 22 comprises a printing mechanism or printer. In other embodiments, fluid receiver 22 may comprise other devices that consume fluid in use. Fluid receiver 22 includes housing 26, media transport 28, marking device 30, fluid interface 32, pressurization system 33, seals 34, 36 and controller 38.

Housing 26 comprises a frame, enclosure or other structures configured to support and contain the remaining components of fluid receiver 22. In one embodiment, housing 26 includes a cavity, recess or depression configured to receive or otherwise mate with fluid supply 24. In other embodiments, housing 26 may have other configurations.

Media transport 28 comprises a mechanism configured to transport or move print media relative to marking device 30. In one embodiment, media transport 28 may be configured to transport individual sheets of print media relative to marking device 30. In still other embodiments, media transport 28 may be configured to transport a substantially continuous web of media to be printed upon by marking device 30. Media transport 28 may utilize rollers, belts, conveyors, one or more drums or other mechanism for transporting such media.

Marking device 30 comprises a device configured to deposit fluid upon media supported by media transport 28. In one embodiment, marking device 30 may comprise one or more drop-on-demand inkjet print heads. Examples of such print heads include thermal inkjet print heads and piezoelectric inkjet print heads. In one embodiment, marking device 30 may scan or reciprocate such print heads back and forth across the media being printed upon. In another embodiment, marking device 30 may extend substantially across a dimension of the media being printed upon, such as with a page-wide-array print device. In yet other embodiments, marking device 30 may comprise other devices which deposit fluid onto a printable substrate. For purposes of this disclosure, a printable substrate or print media is any sheet or web of material upon which a liquid or solution (sometimes referred to as a marking fluid) may be patterned, ejected or otherwise deposited. Such a substrate may comprise a cellulose base material, such as paper, a polymeric based material or other materials such as metals.

In one embodiment, marking device 30 may be configured to deposit one more colors of fluid ink onto the media being printed upon. In yet other embodiments, marking device 30 may be configured to selectively deposit or apply other fluids upon a media or other substrate provided by media transport 28. In embodiments where fluid receiving device 22 does not comprise a printing mechanism, media transport 28 and marking device 30 may be omitted.

Fluid interface 32 comprises an arrangement of structures or components configured to receive and transmit fluid from fluid supply 24 to marking device 30. Fluid interface 32 includes needle 39, valve member 40, bias 42, fluid passage 44, pressure source 46 and pressure interface 48. Needle 39 comprises an elongate post, column, or pin having an interior 50 serving as a fluid passage. Needle 39 is configured to be inserted into fluid supply 24 during transmission of fluid from fluid supply 24.

As shown by FIG. 1, needle 39 includes an axial opening 52 through which fluid may be transmitted into interior 50. Because opening 52 is an axial opening on an end of needle 39, as compared to a side opening, a fluid connection between the receiver 22 and supply 24 may be achieved in a more compact and less space consuming manner In particular, the "end" opening 52 reduces an extent to which needle 39 must be inserted into fluid supply 24. In addition, as compared to a side opening, the "end" opening 52 is more robust with respect to tolerance variability. In other embodiments, needle 39 may include one or more openings or one or more ports at other locations.

Valve member 40 comprises a structure configured to selectively seal or close opening 52 of needle 39. Valve member 40 comprises a ball captured within interior 50 of needle 39 and movable between a closing state (shown in FIG. 1) and an open state withdrawn from opening 52. In other embodiments, valve member 40 may comprise other structures.

Bias 42 comprises a mechanism configured to resiliently bias valve member 40 towards the closing state or sealing position. In the example illustrated, bias 42 comprises a compression spring captured within the interior 50 of needle 39 and urging the ball of valve member 40 into a seated, sealing position across opening 52. In other embodiments, bias 42 may comprise other structures.

Fluid passage 44 comprises a fluid conduit extending from interior 50 of needle 39 to marking device 30. In one embodiment, fluid passage 44 may comprise a flexible tube. In other embodiments, fluid passage 44 may comprise a rigid fluid pipe. Fluid passage 44 may have a variety of different shapes and configurations.

Pressurization system 33 pressurizes the interior 116 of container 100 adjacent the exterior 124 of bag 102 to assist in expelling fluid from fluid supply 24. Pressurization system 33 includes pressure source 46 and pressure interface 48. Pressure source 46 comprises a source of pressurized fluid, such as a pressurized gas or pressurized liquid. Pressure source 46 is configured to deliver such pressurized fluid through interface 48 into an interior of fluid supply 24 to assist in expelling fluid from fluid supply 24.

Seal 34 comprises a structure extending about fluid interface 32 that is configured to seal between fluid receiver 22 and fluid supply 24 about fluid interface 32 when fluid receiver 22 is connected to fluid supply 24. In the example illustrated, seal 34 comprises an annular ring of compressible or rubber-like material, which when pressed against opposite sealing surfaces of fluid supply 24 forms a pneumatic seal.

Seal 36 comprises one or more structures extending about pressure interface 48 that are configured to seal between fluid receiver 22 and fluid supply 24 about pressure interface 48. In the example illustrated, seal 36 comprises an annular cup-shaped compressible structure configured to not only abut, but also partially wrap about opposite sealing surfaces of fluid supply 24. Because seal 36 is cup-shaped, seal 36 provides a more reliable seal against fluid supply 24 while at the same time allowing easier and less complex disconnection of supply 24 from receiver 22. For example, in one embodiment, fluid supply 24 may be moved in a direction along the center line 37 of fluid supply 24 to withdraw fluid supply 24 from fluid receiver 22. Because seal 36 is annular, fluid supply 24 may be rotated about its centerline 37 during connection or disconnection of fluid supply 24 and fluid receiver 22. In other embodiments, seal 36 may have other configurations.

Controller 38 comprises one or more processing units configured to generate control signals directing the operation of media transport 28, marking device 30 and pressure source 46 (when provided). Controller 38 generates such control signals to control the deposition of fluid on media transported by media transport 28. Controller 38 further controls the supply of pressurized fluid by pressure source 46 to at least partially control the rate at which fluid is expelled from fluid supply 24 and received by fluid supply 22.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

Fluid supply 24 supplies the consumable fluid to fluid receiver 22. Fluid supply 24 includes container 100, bag 102, fluid 103 and valve assembly 104. Container 100 comprises a substantially imperforate vessel configured to contain and enclose bag 102 and valve assembly 104. Container 100 allows fluid or gas to be injected into container 100 about or around bag 102 to force or expel fluid from bag 102. Container 100 includes bottom 110, annular sidewall 112 and cap 114. For purposes of this disclosure, the term "annular" encompasses both circular and non-circular rings. Bottom 110, sidewall 112 and cap 114 cooperate to form or define an interior 116 configured to contain bag 102 and valve assembly 104. In one embodiment, bottom 110 and cap 114 are substantially circular while sidewall 112 is substantially cylindrical. In other embodiments, bottom 110, cap 114 and sidewall 112 may have other shapes, such as polygonal shapes.

As schematically shown by FIG. 1, cap 114 comprises a one-piece cap integrally formed as a single unitary body. Cap 114 is joined to a remainder of container 100. In the example illustrated, cap 114 is fixedly sealed to container 100. For example, one embodiment, cap 114 is permanently welded to side wall of container 100. Cap 114 includes fluid interfaces 118 and 120. Because cap 114 comprises a single unitary body one piece structure that provides both fluid interfaces 118 and 120, cap 114 reduces assembly time and cost for fluid supply 24. In addition, cap 114 has fewer parts in that it may omit multiple gaskets, O-rings and the like which might otherwise have to be provided, increasing costs and assembly complexity. Moreover, because cap 114 comprises a one-piece cap or a one-piece structure, precise control of the relative positioning of fluid interfaces 118 and 120 may be achieved during molding or other fabrication of cap 114, reducing tolerance stack. Such control over the relative positioning of fluid interfaces 118 and 120 better assures more reliable connection of the interfaces 118, 120 with corresponding interfaces of fluid receiver 22.

Fluid interface 118 is configured to permit fluid to be injected into or expelled from an interior of bag 102. In the example illustrated, fluid interface 118 comprises an opening in fluid communication with an interior of valve simply 104. The opening of interface 118 is sized and shaped so as to receive needle 39 of fluid receiver 22. The opening of fluid interface 118 facilitates fluid flow from bag 102 through needle 39 into fluid receiver 22. In particular circumstances, the opening of fluid interface 118 may also be utilized to allow fluid to be supplied into bag 102. Fluid interface 118 is substantially aligned with a centerline or central axis 37 of container 100. Although fluid interface 118 is illustrated as comprising an opening, serving as a female feature which receives a male feature (needle 39 of a corresponding fluid receiver interface), in other embodiments fluid interface 118 may alternatively comprise a male feature, wherein the fluid interface associated with the fluid receiver comprises a female fluid interface.

Pressure interface 120 comprises an interface configured to cooperate with interface 48 of fluid receiver 22 such that air or other gas may be injected into container 100 between container 100 and an exterior 124 of bag 102. At the same time, pressure interface 120 facilitates more precise, accurate and reliable connection of fluid supply 24 to fluid receiver 22. Pressure interface 120 includes center portion 122, channel 123, outer rim 124 and openings 125A, 125B (collectively referred to as openings 125).

Center portion 122 comprises that portion of cap 114 extending about the opening of fluid interface 118 and centered about centerline 37. Center portion 122 extends generally opposite to seal 34 when fluid supply 24 is connected to fluid receiver 22. Center portion 122 comprises a hub or platform that provides a sealing surface against which seal 30 abuts to form a pneumatic seal between the opening of fluid interface 118 and channel 123 of fluid interface 120.

Channel 123 concentrically extends about center portion 122 and forms an annular groove or recess through which air or other gas may flow around center portion 122 to each of openings 125. In the example illustrated, channel 123 further provides a depression or cavity into which pressure interface 48 may extend when fluid supply 24 is connected to fluid receiver 22. In other embodiments, pressure interface 48 may alternatively not extend into channel 123. As shown by FIG. 1, channel 123 is defined by a floor 126 and a pair of opposing side walls 127. Because channel 123 concentrically extends about fluid interface 118, angular or rotation alignment of fluid interface 48 is less difficult. In particular, fluid interface 48 may be positioned opposite to or into any portion of channel 123 about fluid interface 118 while still allowing a pressurizing air or gas to be directed into interior 116 through openings 125.

Rim 124 comprises that portion of cap 114 extending outward of channel 123. Rim 124 provides a sealing surface against which seal 36 may abut to form a pneumatic seal about and outside of channel 123. In the example illustrated, rim 124 has a radial width W such that rim 124 may be received within seal 136, allowing seal 136 to wrap about three sides of rim 124 for an enhanced pneumatic seal. Because rim 124 concentrically extends about fluid interface 118, connection of fluid interface 32 and fluid interface 118 also serves to align rim 124 with respect to seal 36 for an enhanced pneumatic seal.

Openings 125 comprise apertures extending through floor 126 to interior 116 of container 100. In the example illustrated, openings 125 comprise two diametrically opposed apertures on opposite sides of fluid interface 118. As a result, air or other pressurized gas may flow through openings 125 into interior 116 on opposite side of bag 102 for more uniform and dispersed application of pressure to bag 102 to expel fluid from bag 102. In effect, bag 102 is squeezed from opposite sides for more liable expulsion of fluid. Although fluid interface 120 is illustrated as including two diametrically opposed openings 125, in other embodiments, fluid interface 120 may include greater than two apertures or openings 125 spaced along channel 123 through floor 126.

Bag 102 comprises a flaccid, flexible or collapsible vessel or film configured to contain fluid 103 and to separate or isolate fluid 103 from container 100 within interior 116. Bag 102 has an interior 128 and an exterior 129. Interior 128 is fluidly coupled to or in fluid communication with an interior of valve assembly 104. Likewise, interior 128 is fluidly coupled to opening 118 when valve assembly 104 is in an open state. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. The term "fluidly coupled" shall mean that two are more fluid transmitting volumes are connected directly to one another or are connected to one another by intermediate volumes or spaces such that fluid may flow from one volume into the other volume.

Bag 102 is formed from one or more materials configured to contain fluid 103 while substantially inhibiting permeation of air, fluid or other gases through the walls of bag 102 into the fluid 103 within bag 102. In some embodiments, bag 102 is configured to contain fluid 103 while maintaining fluid 103 in a substantially degassed state Fluid 103 comprises a fluid utilized by fluid receiver 22. In one embodiment, fluid 103 comprises a liquid. In one embodiment where fluid receiver 22 comprises a printing mechanism or system or device, fluid 103 comprises a printing liquid or solution (also known as a marking fluid). In embodiments where text, graphics or other images are to be printed upon a medium, fluid 103 may comprise an ink. For example, fluid 103 may comprise a black ink or one of various colors of ink. In yet another embodiment, fluid 103 may comprise others liquid solutions carrying solutes which are to be patterned upon a substrate by a fluid ejection device.

Valve assembly 104 comprises an assembly or mechanism configured to control the flow of fluid into and/out of interior 122 of bag 102 within container 100. Valve assembly 104 is further configured to interface with needle 39 of fluid receiver 22 to transmit fluid through needle 39 into receiver 22. Moreover, at substantially the same time that valve assembly 104 is actuated to an open state due to its interaction with needle 39, valve assembly 104 substantially concurrently actuates valve member 40 to open state or open position. Consequently, valves of both receiver 22 and supply 24 are concurrently opened to facilitate fluid flow therebetween. Upon disconnection, the valves of both receiver 22 and supply 24 are automatically closed to retain existing fluid within receiver 22 and supply 24 while also inhibiting the drying of such existing fluid. As a result, dried fluid is less likely to occlude fluid passages or interiors of fluid receiver 22 or fluid supply 24.

As shown by FIG. 1, valve assembly 104 includes fluid seal 130, valve body 132, valve stem 134 and bias 136. Fluid seal 130 comprises a gasket, ring or other structure of compressible material extending about opening 118 within an interior 116 of container 100. Fluid seal 130 is configured to cooperate with valve stem 134 to close opening 118 when valve stem 134 is in a closed state. Although seal 130 is disclosed as being compressible, elastomeric or rubber-like while those portions of valve stem 134 that contact seal 130 are substantially rigid, in other embodiments, this relationship may be reversed where seal 130 comprises an annular rigid blade-like member and valve stem 134 includes an elastomeric, compressible, rubber-like mating and sealing structure.

Valve body 132 comprises one or more structures configured to contain the remaining components of valve assembly 104 proximate to opening 118 of container 100. Valve body 132 is substantially imperforate and extends about opening 118 within interior 116 of container 100. Valve body 132 includes a port 138 fluidly connecting interior 128 of bag 102 to an interior 140 of body 132. Port 138 allows fluid 103 to enter interior 140 of body 132.

Valve stem 134 comprises a structure within valve body 132 configured to control the flow of fluid through valve body 132 and to also actuate valve member 40 of fluid receiver 22. Valve stem 134 projects into needle 39 during reception of needle 39 by opening 118 and by valve body 132. Valve stem 134 includes base 150, annular blade 152 and pin 154. Base 150 supports blade 152 and pin 154. Blade 152 projects from base 150 and is configured to contact and sealingly engage with seal 130 when valve stem 134 is moved to a sealing position as shown in FIG. 1. Blade 152 completely extends around pin 154 and completely closes off opening 118 when valve stem 134 is in the sealing position shown.

Pin 154 projects from base 150 and is surrounded by blades 152. Pin 154 is configured to project into interior 50 of needle 39 when needle 39 is inserted through opening 118 into body 132 where it is surrounded by blade 152. Pin 154 is further configured to contact valve member 40 to move valve member 40 against bias 42 from a sealing or closed state or position to an open state or position. In the example illustrated, pin 154 has an axial end or head 156 configured to contact or abut valve member 40 during connection of fluid supply 24 with fluid receiver 22.

In the example illustrated, pin 154 includes flow passages 158 at least partially along its axial length. Flow passages 158 facilitate insertion of pin 154 into interior 50 of needle 39 against valve member 40 and bias 42 while providing a passage through which fluid may flow from the interior 140 of valve body 132 and from bag 102 into interior 50 of needle 39. In one embodiment, flow paths 158 extend along the sides of pin 154. In one embodiment, flow paths 158 are formed by castellations 160 circumferentially spaced about and axially extending along pin 154. In other embodiments, flow paths 158 may be provided at other locations along or through pin 154.

Bias 136 comprises one or more members configured to resiliently urge or bias valve stem 134 towards the closing or sealed position shown in FIG. 1. In the example illustrated, bias 136 comprises a compression spring captured between base 150 of valve stem 134 and valve body 132. The spring of bias 136 has a spring constant such that engagement of needle 39 with valve stem 134 or engagement of valve member 40 with pin 154 will result in compression of bias 136 and movement of valve stem 134 towards bottom 110 to an open position. At the same time, the spring constant of bias 42 with respect to the spring constant of bias 136 is such that engagement of pin 154 against valve member 40 results in compression of bias 42 and movement of valve member 42 and open state. In other embodiments, bias 136 may have other configurations.

Figure 2:
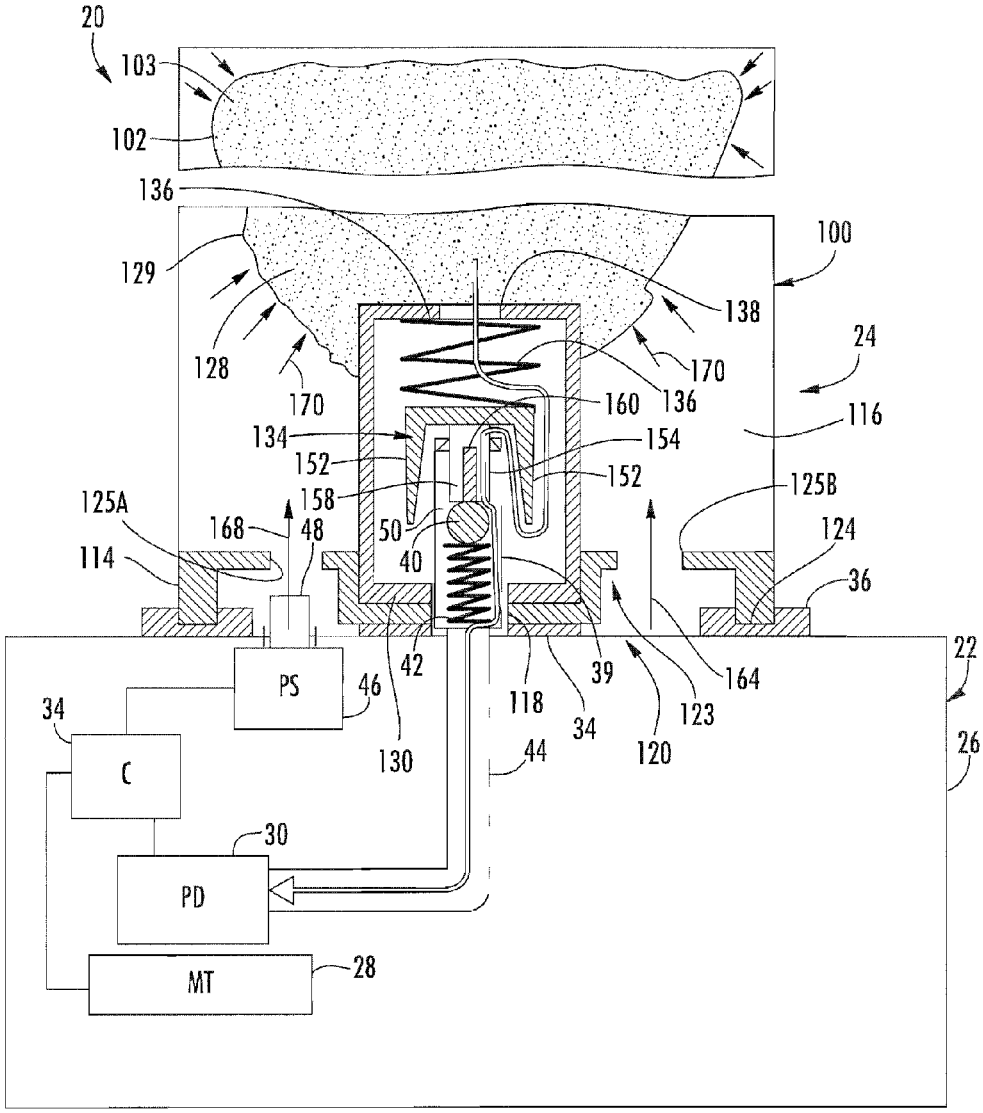
FIG. 2 is a schematic illustration of the fluid supply and receiving system of FIG. 1 in a connected state according to an example embodiment.

FIG. 2 illustrates system 20 with fluid supply 24 connected to fluid receiver 22. FIG. 2 illustrates the supply of fluid to receiver 22. As shown by FIG. 2, fluid supply 24 is brought into mating, interlocking are coupled relationship with respect to fluid receiver 22. As a result, interface 48 is received through opening 120 to provide communication between pressure source 46 and interior 116 of container 100. This also results in needle 39 being inserted through opening 118. During such insertion of needle 39 through opening 118, seal 130 seals against sides of needle 39. At the same time, pin 154 exerts a force upon valve member 40 to compress bias 42 so as to open opening 52 (shown in FIG. 1) of needle 39. Valve member 40 and bias 42 also exert force upon pin 154 so as to move valve stem 134 against bias 136 to the open position. As a result, as indicated by arrow 164, a fluid passage is formed from the interior 122 of bag 102 through opening 138 into valve body 132, along flow passages 158 into interior 50 of needle 39 and through fluid passage 44 to marking device 30 (or other fluid consuming devices of receiver 22).

In response to entry of commands from a user or external electronic device or in response to signals from one or more sensors indicating proper connection of fluid supply 24 to receiver 22, controller 38 generates control signals correcting pressure source 46 to supply pressurized fluid to the interior 116 of container 100 as indicated by arrow 168. As indicated by arrows 170, the pressurization of interior 116 exerts a force against exterior 124 of bag 102 to compress or squeeze fluid 103 out of bag 102 and along the aforementioned fluid path. Upon a sufficient volume or amount of fluid being transferred to fluid receiver 22, fluid supply 24 may be disconnected from fluid receiver 22. In response to such disconnection, bias 42 automatically returns valve member 40 to the closed position shown in FIG. 1 and bias 136 automatically returns the valve stem 134 to the closed position shown in FIG. 1.

FIGS. 3-7 illustrate fluid supply and receiving system 220, another embodiment of system 20 shown in FIGS. 1 and 2. System 220 is similar to system 20 in that system 220 provides a compact arrangement of features for connecting a fluid supply to fluid receiver while facilitating reliable fluid seals for both the fluid supply and the fluid receiver to inhibit drying of fluid within the fluid passages of the supply and the receiver. As with system 20, system 220 includes a fluid receiver 222 (shown separately in FIGS. 4 and 5) and a fluid supply 224 (shown in FIGS. 3, 6 and 7).

Fluid receiver 222 comprises a device configured to receive and consume fluid. In the example illustrated, fluid receiver 222 comprises a printing mechanism or printer. In other embodiments, fluid receiver 222 may comprise other devices that consume fluid in use. Fluid receiver 222 includes housing 26, media transport 28, marking device 30 and controller 38, each of which is shown and described above with respect to FIG. 1. Fluid receiver 222 additionally includes fluid interface 232, pressurization system 233 and seals 234, 236 in place of fluid interface 32, pressurization system 33 and seals 34, 36, respectively.

Figure 5:
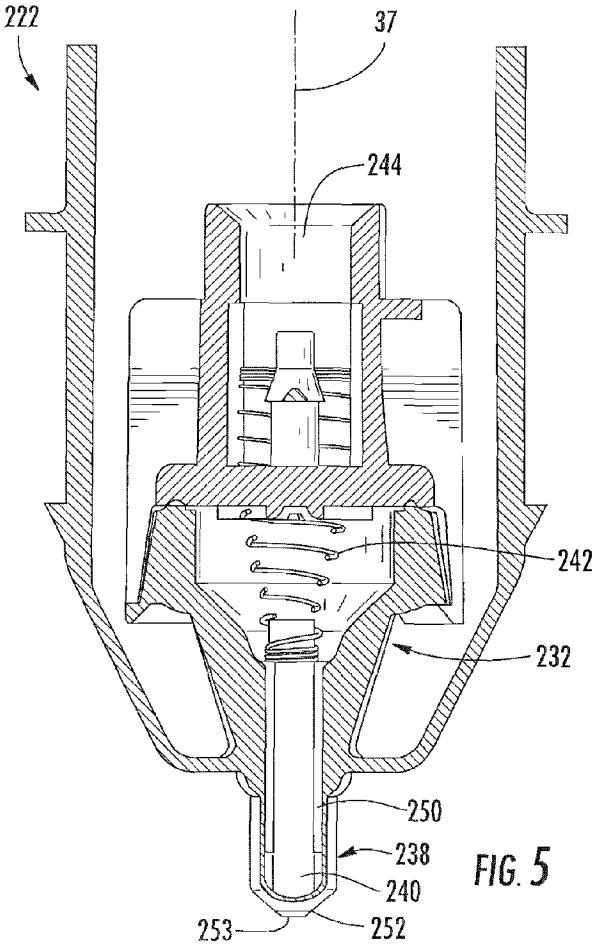
FIG. 5 is a sectional view of the fluid receiver of FIG. 4 according to an example embodiment.
Figure 4:
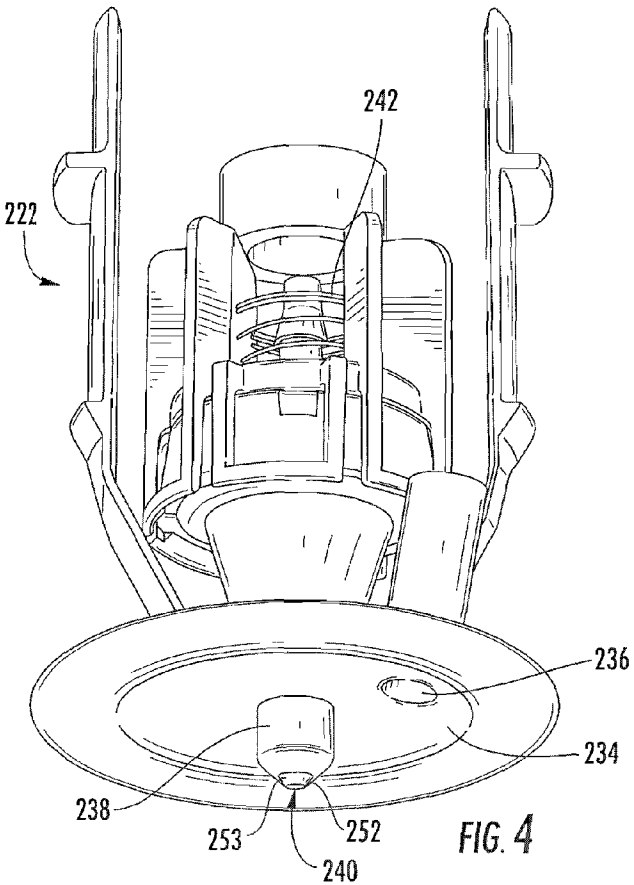
FIG. 4 is a bottom perspective view of a portion of a fluid receiver of the system of FIG. 3 according to an example embodiment.

Fluid interface 232 comprises an arrangement of structures or components configured to receive and transmit fluid from fluid supply 224 to marking device 30. In the example illustrated, fluid interface 232 is further configured to assist in expelling fluid from fluid supply 224. As shown by FIGS. 4 and 5, fluid interface 232 includes needle 238, valve member 240, bias 242 and fluid passage 244. Needle 238 comprises an elongate post, column, or pin having an interior 250 serving as a fluid passage. Needle 238 is configured to be inserted into fluid supply 224 during transmission of fluid from fluid supply 224.

Figure 3:
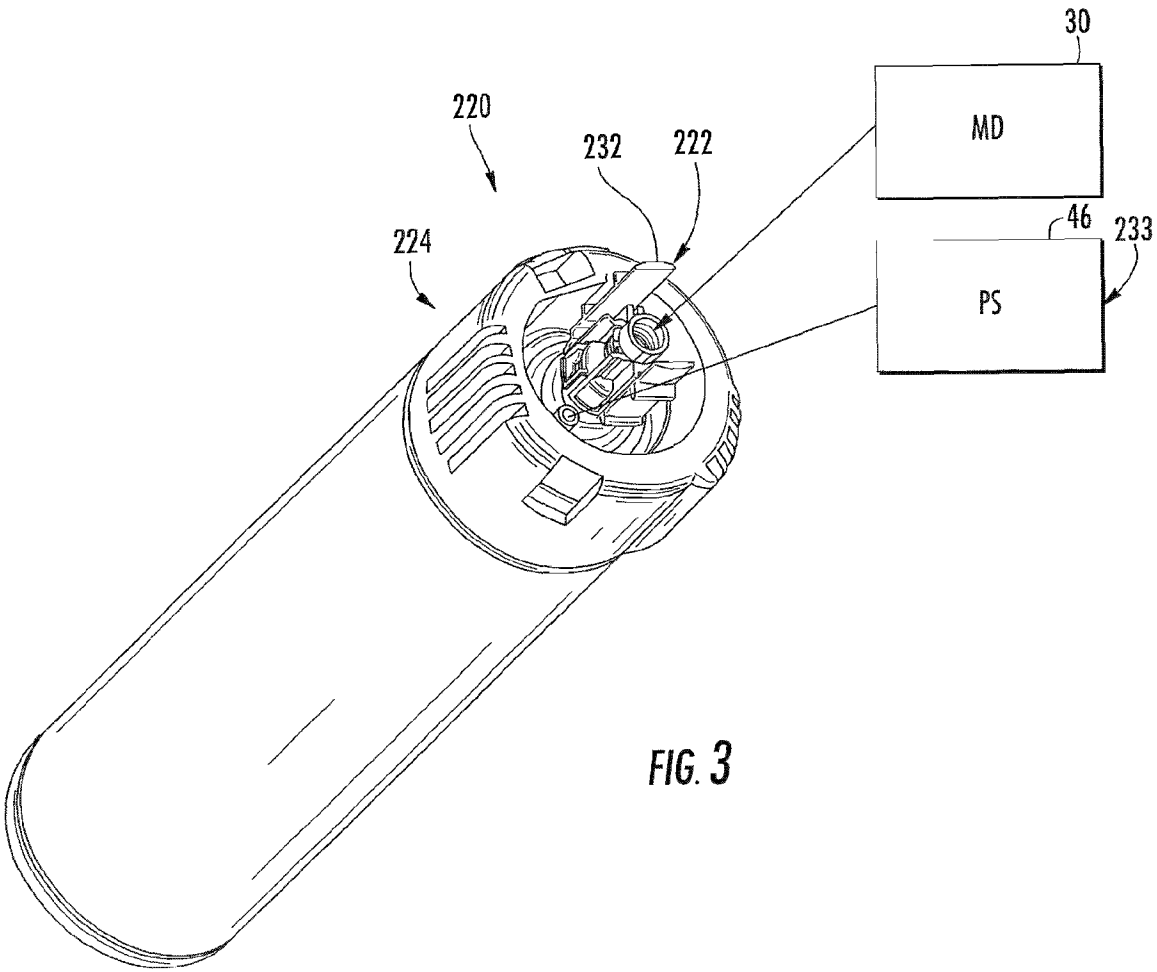
FIG. 3 is a perspective view of another embodiment of the fluid supply and receiving system of FIG. 1 in a connected state according to an example embodiment.

As shown by FIG. 3, needle 238 includes an axial opening 252 through which fluid may be transmitted into interior 250. Because opening 252 has an axial opening 252 on an end of needle 238, as compared to a side opening, a fluid connection between the receiver 222 and supply 224 may be achieved in a more compact and less space consuming manner. In particular, the "end" opening 252 reduces an extent to which needle 238 must be inserted into fluid supply 224. In addition, as compared to a side opening, of the "end" opening 252 is more robust with respect to tolerance variability. In other embodiments, needle 238 may include one or more openings or one or more ports at other locations.

Figure 7:
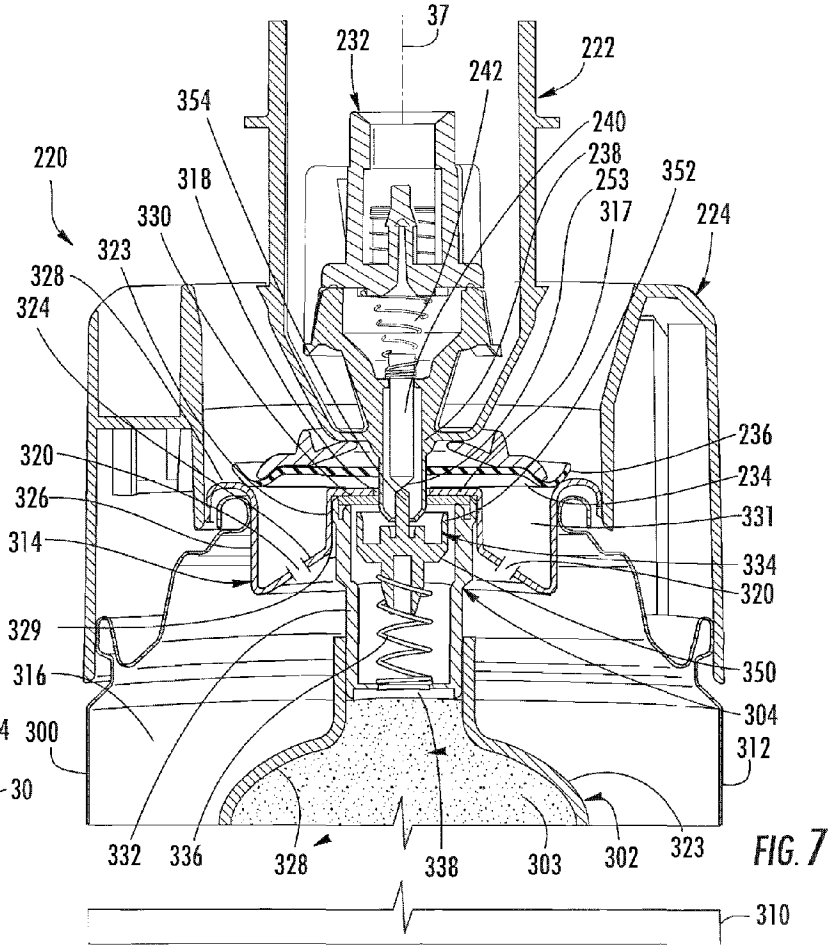
FIG. 7 is a sectional view of the fluid supply and receiving system of FIG. 1 in the connected state according to an example embodiment.
Figure 6:
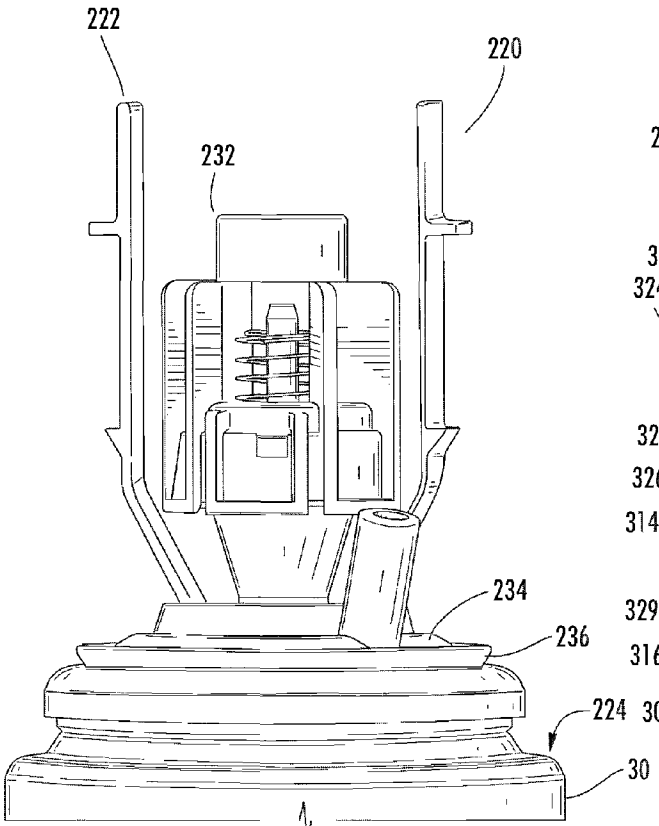
FIG. 6 is a fragmentary side elevation of view of the fluid supply and receiving system of FIG. 1 in the connected state, with portions omitted for purposes of illustration, according to an example embodiment.

Valve member 240 comprises a structure configured to selectively seal or close opening 252 of needle 238. In the example illustrated, valve member 240 comprises a pin or shaft extending within interior 250 and terminating at a frustro-conical end 253. Valve member 240 moves between a closed state that seals and closes axial opening 252 (as seen in FIG. 4) and an open state in which fluid is allowed to flow through opening 252 (as seen in FIG. 7). In other embodiments, valve member 240 may comprise other structures. For example, and other embodiments, valve member 240 may alternatively comprise a ball captured within interior 250 of needle 238 and is movable between a closing state and an open state withdrawn from opening 252.

Bias 242 comprises a mechanism configured to resiliently bias valve member 240 towards the closing state or sealing position. In the example illustrated, bias 242 comprises a compression spring captured within the interior 250 of needle 238 and urging end 253 of valve member 240 into a seated, sealing position across opening 252. In other embodiments, bias 242 may comprise other structures.

Fluid passage 244 (schematically shown) comprises a fluid conduit extending from interior 250 of needle 238 to marking device 30 (shown in FIGS. 1 and 3). In one embodiment, fluid passage 244 may comprise a flexible tube. In other embodiments, fluid passage 244 may comprise a rigid fluid pipe. Fluid passage 244 may have a variety of different shapes and configurations.

Pressurization system 233 pressurizes the interior 116 of container 100 adjacent the exterior 324 of bag 302 to assist in expelling fluid from fluid supply 224. Pressurization system 233 includes pressure source 46 and pressure interface 48. Pressure source 46 comprises a source of pressurized fluid, such as a pressurized gas or pressurized liquid. Pressure source 46 is configured to deliver such pressurized fluid through interface 48 into an interior of fluid supply 24 to assist in expelling fluid from fluid supply 224.

Seal 234 comprises a structure extending about fluid interface 232 that is configured to seal between fluid receiver 222 and fluid supply 224 about fluid interface 232 when fluid receiver 222 is connected to fluid supply 224. In the example illustrated, seal 234 comprises an annular ring of compressible or rubber-like material, which when pressed against opposite sealing surfaces of fluid supply 224 to form a pneumatic seal.

Seal 236 comprises one or more structures extending about pressure interface 248 that are configured to seal between fluid receiver 222 and fluid supply 224 about pressure interface 248. In the example illustrated, seal 236 comprises a semi-cylindrical or curved annular lip of compressible structure configured to abut against opposite sealing surfaces of fluid supply 224. Because seal 236 is annular, fluid supply 24 may be rotated about its centerline 37 during connection or disconnection of fluid supply 24 and fluid receiver 22. In other embodiments, seal 236 may have other configurations.

Fluid supply 224 supplies the consumable fluid to fluid receiver 222. Fluid supply 224 includes container 300, bag 302, fluid 303 (schematically shown) and valve assembly 304. Container 300 comprises a substantially imperforate vessel configured to contain and enclose bag 302 and valve assembly 304. Container 300 allows fluid to be injected into container 300 around or about bag 302 to force or expel fluid from bag 302. Container 300 includes bottom 310, annular sidewall 312 and cap 314. In one embodiment, bottom 310 and cap 314 are substantially circular while sidewall 312 is substantially cylindrical. In other embodiments, bottom 310, cap 314 and sidewall 312 may have other shapes, such as polygonal shapes. As shown by FIG. 3, bottom 310, sidewall 312 and cap 314 cooperate to further define an interior 316 configured to contain bag 302 and valve assembly 304.

As shown by FIG. 3, cap 314 includes center portion 317, annular walls 323, floor portion 324, annular wall 326 and rim 328. Center portion 317 comprises a substantially planar plateau defining or forming opening 318. Opening 318 is in fluid communication with an interior of valve assembly 304. Opening 318 is sized and shaped so as to receive needle 238 of fluid receiver 222. Opening 318 facilitates fluid flow from bag 302 through needle 238 and to fluid receiver 222. In particular circumstances, opening 318 may also be utilized to allow fluid to be supplied into bag 302. In example illustrated, opening 318 is substantially aligned with a centerline or central axis 37 of container 300. In other embodiments, opening 318 may be at other locations.

Wall 323 extends from center portion 317 towards a bottom 310. Wall 323 is substantially annular and cooperates with center portion 317 to form a cup-shaped central portion of cap 314 having a depression or cavity 329 which faces an interior of the container and which receives, retains and aligns a portion of valve assembly 304 with opening 318. Floor portion 324 extends outwardly from walls 322. Whereas wall 323 is substantially perpendicular with respect to center portion 317, floor portion 324 is substantially perpendicular or oblique with respect to wall 323. Floor portion 324 forms one or more openings 320.

Openings 320 comprise one or more apertures in fluid communication with or fluidly coupled to interior 316 of container 300 along an exterior of bag 302. Opening 320 is configured to permit fluid, such as a liquid or a gas, to be injected into interior 316 so as to pressurize the interior 316 so as to expel fluid 303 through valve assembly 304 and opening 318. Openings 320 comprise apertures extending through floor 324 to interior 316 of container 300. In the example illustrated, openings 320 comprise two diametrically opposed apertures on opposite sides of valve assembly 304. As a result, air or other pressurized gas may flow through openings 320 into interior 316 on opposite side of bag 302 for more uniform and dispersed application of pressure to bag 302 to expel fluid from bag 302. In effect, bag 302 is squeezed from opposite sides for more liable expulsion of fluid. Although cap 314 is illustrated as including two diametrically opposed openings 320, in other embodiments, cap 314 may include greater than two apertures or openings 320 spaced along floor 324. In the example illustrated, each opening 320 remains in an open state upon withdrawal of interface 232. In other embodiments, openings 320 may be provided with a septum, temporary seal or a valve mechanism so as to be in a closed state prior to initial connection to a fluid receiver 222 for the first time or each time that interface 232 is withdrawn from opening 318.

Wall 326 annually extends around opening 318 and extends from floor portion 324 away from bottom 310. Wall 326 along with floor portion 324 and wall 323 form an annular channel 331 extending about opening 318. Channel 323 concentrically extends about center portion 317 and forms an annular groove or recess through which air or other gas may flow around center portion 323 to each of openings 320. Because channel 331 concentrically extends about valve assembly 304, angular or rotational alignment of fluid interface 304 with fluid interface 232 is less difficult. In particular, fluid interface 232 may be positioned opposite to channel 331 about fluid interface 304 while still allowing a pressurizing air or gas to be directed into interior 316 through openings 320.

Rim 328 extends from wall 326 and wraps around a center portion of an intermediate wall 333 which is itself joined to sidewall of container 300. In one embodiment, rim 328 is outwardly bent and crimped to a remainder of container 300. In other embodiments, rim 328 may be secured to the rest of container 300 in other fashions, such as by welding, bonding, mechanical interlocks and the like. In yet other embodiments, cap 314 may alternatively be integrally formed as part of a single unitary body with at least portions of a remainder of container 300.

Bag 302 comprises a flaccid, flexible or collapsible vessel or film configured to contain fluid 303 and to separate or isolate fluid 303 from container 300 within interior 316. Bag 302 has an interior 322 and an exterior 324. Interior 322 is fluidly coupled to or in fluid communication with an interior of valve assembly 304. Likewise, interior 322 is fluidly coupled to opening 318 when valve assembly 304 is in an open state. Bag 302 is formed from one or more materials configured to contain fluid 303 while substantially inhibiting permeation of air, fluid or other gases through the walls of bag 302 into the fluid 303 within bag 302.

Fluid 303 comprises a fluid utilized by fluid receiver 222. In one embodiment, fluid 303 comprises a liquid. In one embodiment where fluid receiver 222 comprises a printing mechanism, fluid 303 comprises a printing fluid or marking fluid. In embodiments where text, graphics or other images are to be printed upon a medium, fluid 303 may comprise a fluid ink. For example, fluid 303 may comprise a black ink are one of various colors of ink. In yet another embodiment, fluid 303 may comprise others liquid solutions carrying solutes which are to be patterned upon a substrate.

Valve assembly 304 comprises an assembly or mechanism configured to control the flow of fluid into and out of interior 328 of bag 302 within container 300. Valve assembly 304 is further configured to interface with needle 238 of fluid receiver 222 to transmit fluid through needle 238 into receiver 222. Moreover, at substantially the same time that valve assembly 304 is actuated to an open state due to its interaction with needle 238, valve assembly 304 substantially concurrently actuates valve member 240 to an open state or position. Consequently, valves of both receiver 222 and supply 224 are concurrently opened to facilitate fluid flow therebetween. Upon disconnection, the valves of both receiver 222 and supply 224 are concurrently closed to retain existing fluid within receiver 222 and supply 224 while also inhibiting the drying of such existing fluid. As a result, dried fluid is less likely to occlude fluid passages or interiors of fluid receiver 222 or fluid supply 224.

As shown by FIG. 7, valve assembly 304 includes fluid seal 330, valve body 332, valve stem 334 and bias 336. Fluid seal 330 comprises a gasket, ring or other structure of compressible material extending about opening 318 within an interior 316 of container 300. Fluid seal 330 is configured to cooperate with valve stem 334 to close opening 318 when valve stem 334 is in a closed state. Although seal 330 is disclosed as being compressible, elastomeric or rubber-like while those portions of valve stem 334 that contact seal 330 are substantially rigid, in other embodiments, this relationship may be reversed where seal 330 comprises an annular rigid blade-like member and valve stem 334 includes an elastomeric, compressible, rubber-like mating and sealing structures.

Valve body 332 comprises one or more structures configured to contain the remaining components of valve assembly 304 proximate to opening 318 of container 300. Valve body 332 is substantially imperforate and extends about opening 318 within interior 316 of container 300. Valve body 332 includes a port 338 fluidly connecting interior 322 of bag 302 to an interior 340 of body 332. Port 338 allows fluid 303 to enter interior 340 of body 332.

Figure 8:
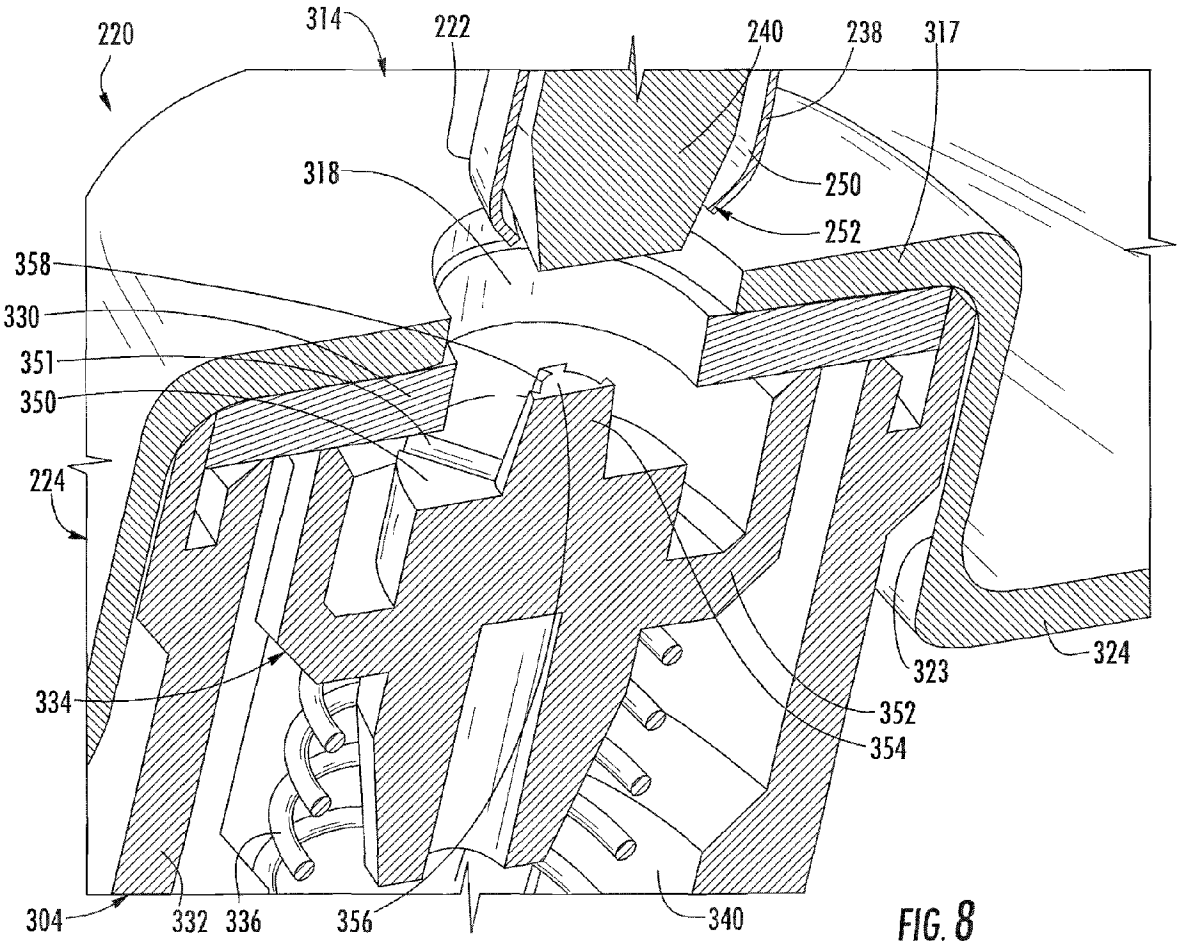
FIG. 8 is a fragmentary sectional view of the fluid receiver disconnected from a fluid supply of the system of FIG. 3 according to an example embodiment.

Valve stem 334 comprises a structure within valve body 332 configured to control the flow of fluid through valve body 332 and to also actuate valve member 240 of fluid receiver 222. Valve stem 334 projects into needle 238 during reception of needle 238 by opening 318 and by valve body 332. Valve stem 334 includes base 350, annular blade 352 and pin 354. Base 350 supports blade 352 and pin 354. Blade 352 projects from base 350 and is configured to contact and sealingly engage with seal 330 when valve stem 334 is moved to a sealing position as shown in FIG. 8. Blade 352 completely extends around pin 354 and completely closes off opening 318 when valve stem 334 is in the sealing position shown.

Pin 354 projects from base 350 and is surrounded by blades 352. Pin 354 is configured to project into interior 250 of needle 238 when needle 238 is inserted through opening 318 into body 332 where it is surrounded by blade 352. Pin 354 is further configured to contact valve member 240 to move valve member 240 against bias 242 from a sealing or closed state or position to an open state or position. In the example illustrated, pin 354 has an axial end or head 356 configured to contact in valve member 240 during connection of fluid supply 224 with fluid receiver 222.

As shown by FIG. 8, in the example illustrated, pin 354 includes flow passages 358 at least partially along its axial length. Flow passages 358 facilitate insertion of pin 354 into interior 250 of needle 238 against valve member 240 and bias 242 while providing a passage through which fluid may flow from the interior 340 of valve body 332 and from bag 302 into interior 250 of needle 238. In one embodiment, flow paths 358 extend along the sides of pin 354. In one embodiment, flow paths 358 are formed by castellations 360 encircling pin 354. In other embodiments, flow paths 358 may be provided at other locations along or through pin 354.

Bias 336 comprises one or more members configured to resiliently urge or bias valve stem 334 towards the closing or sealed position shown in FIG. 3. In the example illustrated, bias 336 comprises a compression spring captured between base 350 of valve stem 334 and valve body 332. The spring of bias 336 has a spring constant such that engagement of needle 238 with valve stem 334 or engagement of valve member 240 with pin 354 will result in compression of bias 336 and movement of valve stem 334 towards bottom 310 to an open position. At the same time, the spring constant of bias 242 with respect to the spring constant of bias 336 is such that engagement of pin 354 against valve member 240 results in compression of bias 242 and movement of valve member 240 to an open state. In other embodiments, bias 336 may have other configurations.

FIG. 7 illustrates system 220 of fluid supply 224 connected to fluid receiver 222. FIG. 5 illustrates the supply of fluid to receiver 222. As shown by FIG. 7, fluid supply 224 is brought into mating, interlocking or coupled relationship with respect to fluid receiver 222. This results in interface 48 being received through opening 320 to provide communication between pressure source 46 (shown in FIG. 1) and interior 316 of container 300. This also results in needle 238 being inserted through opening 318. During such insertion of needle 238 through opening 318, seal 330 seals against sides of needle 238. At the same time, pin 354 exerts a force upon valve member 240 to compress bias 242 so as to open opening 252 of needle 238. Valve member 240 and bias 242 also exert force upon pin 354 so as to move valve stem 334 against bias 336 to the open position. As a result, a fluid passage is formed from the interior 322 of bag 302 through opening 338 into valve body 332, along flow passages 358 into interior 250 of needle 238 and through fluid passage 244 to marking device 303 (or other fluid consuming devices of receiver 222).

In response to entry of commands from a user or external electronic device or in response to signals from one or more sensors indicating proper connection of fluid supply 224 to receiver 222, controller 38 (shown in FIG. 1) generates control signals correcting pressure source 46 to supply pressurized fluid to the interior 316 of container 300. The pressurization of interior 316 exerts a force against exterior 324 of bag 302 to compress or squeeze fluid 303 out of bag 302 and along the aforementioned fluid path. Upon a sufficient volume or amount of fluid being transferred to fluid receiver 222, fluid supply 224 may be disconnected from fluid receiver 222. In response to such disconnection, bias 242 automatically returns valve member 240 to the closed position shown in FIG. 3 and bias 336 automatically returns the valve stem 334 to the closed position shown in FIG. 4.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A fluid supply comprising:
a container;
a bag within the container; and
a cap coupled to the container, the cap comprising:
a center portion spanning a centerline of the container;
a valve mechanism at the center portion;
an annular channel concentrically extending about the center portion, the annular channel having at least one first opening in continuous communication with an exterior of the bag independent of application of an external force; and
an outer rim about the channel, wherein the center portion and the rim form inner and outer sealing surfaces, respectively, about the channel.

2. The fluid supply of claim 1, wherein the annular channel includes a side wall extending from the center portion to form a cap-shaped cavity and wherein the valve mechanism is retained within the cavity.

3. The fluid supply of claim 2, wherein the center portion has an opening aligned with the centerline of the container and wherein the valve mechanism comprises:
a cup-shaped valve body within the cavity, the body having an opening fluidly coupled to an interior of the bag; and
a valve stem movably position within the valve body, the valve stem having an annular blade movable into a sealing position about the opening and a pin opposite the opening.

4. The fluid supply of claim 3, wherein the valve mechanism includes an annular compressible ring within the cavity, against the center portion and about the opening.

5. The fluid supply of claim 3, wherein the valve mechanism is configured to project into a needle of a fluid receiver while the opening has received the needle.

6. The fluid supply of claim 1 further comprising a valve mechanism contained within the container and movable from a closed state to an open state against a bias while engaging and moving a valve member of a fluid receiver from a closed state to an open state.

7. The fluid supply of claim 6, wherein the container has an opening and wherein the valve mechanism comprises:
a seal about the opening;
a valve body about the opening and having a body interior connected to an interior of the bag; and
a valve stem movably positioned within the valve body resiliently biased against the seal.

8. The fluid supply of claim 7, wherein the valve stem includes a pin opposite the opening and configured to be engaged by the needle inserted through the opening.

9. The fluid supply of claim 8, wherein the pin includes castellations providing a fluid path along the pin.

10. The fluid supply of claim 1 further comprising a marking fluid within the bag.

11. The fluid supply of claim 1, wherein the outer rim wraps about and is fixedly sealed to a side wall of the container.

12. The fluid supply of claim 11, wherein the outer rim is welded to the side wall of the container.

13. The fluid supply of claim 1, wherein the at least 1 one opening includes two diametrically opposite openings.

14. A fluid supply comprising:
a container comprising:
a cap integrally formed as a single unitary body, the cap comprising:
a center portion having an opening inline with a centerline of the container;
a first annular wall extending from the center portion forming a cavity facing an interior of the container;
a floor portion extending from the first annular wall, the floor portion including at least one opening in communication with an exterior of the bag;
a second annular wall extending from the floor portion forming an annular channel facing an exterior of the container; and
a rim extending from the second annular wall and fixedly sealed to the second annular side wall, wherein the center portion and the rim form inner and outer sealing surfaces, respectively, completely about the annular channel and the openings;
a flaccid bag within the container;
an annular seal about the opening;
a cup shaped valve body within the cavity, the body having a port fluidly coupled to an interior of the bag;
a valve stem movably positioned within the valve body, and
a spring contained within the valve body and resiliently biasing the valve stem against the seal.

15. A fluid supply comprising:
a container;
a bag within the container; and
a cap coupled to the container, the cap comprising:
a center portion spanning a centerline of the container;
a valve mechanism at the center portion;
an annular channel concentrically extending about the center portion, the annular channel having at least one first opening in communication with an exterior of the bag; and
an outer rim about the channel, wherein the center portion and the rim form inner and outer sealing surfaces, respectively, about the channel;
wherein the annular channel includes a side wall extending from the center portion to form a cap-shaped cavity and wherein the valve mechanism is retained within the cavity;
wherein the center portion has an opening aligned with the centerline of the container and wherein the valve mechanism comprises:

a cup-shaped valve body within the cavity, the body having an opening fluidly coupled to an interior of the bag; and a valve stem movably position within the valve body, the valve stem having an annular blade movable into a sealing position about the opening and a pin opposite the opening; and wherein the valve mechanism is configured to project into a needle of a fluid receiver while the opening has received the needle.

16. A fluid supply comprising:

a container;

a bag within the container; and a cap coupled to the container, the cap comprising:

a center portion spanning a centerline of the container;

a valve mechanism at the center portion;

an annular channel concentrically extending about the center portion, the annular channel having at least one first opening in communication with an exterior of the bag;

an outer rim about the channel, wherein the center portion and the rim form inner and outer sealing surfaces, respectively, about the channel; and a valve mechanism contained within the container and movable from a closed state to an open state against a bias while engaging and moving a valve member of a fluid receiver from a closed state to an open state.

17. The fluid supply of claim 16, wherein the container has an opening and wherein the valve mechanism comprises:

a seal about the opening;

a valve body about the opening and having a body interior connected to an interior of the bag; and a valve stem movably positioned within the valve body resiliently biased against the seal.

18. The fluid supply of claim 17, wherein the valve stem includes a pin opposite the opening and configured to be engaged by the needle inserted through the opening.

19. The fluid supply of claim 18, wherein the pin includes castellations providing a fluid path along the pin.

* * * * *

UNITED STATES PATENT AND TRADEMARK OFFICE

CERTIFICATE OF CORRECTION

PATENT NO. : 8,240,345 B2
APPLICATION NO. : 13/087375
DATED : August 14, 2012
INVENTOR(S) : Ronald J. Ender et al.

It is certified that error appears in the above-identified patent and that said Letters Patent is hereby corrected as shown below:

In column 14, line 20, in Claim 13, after "least" delete "1".

Signed and Sealed this
Twelfth Day of March, 2013

Teresa Stanek Rea
*Acting Director of the United States Patent and Trademark Office*